US006588386B2

(12) United States Patent
Kong

(10) Patent No.: US 6,588,386 B2
(45) Date of Patent: Jul. 8, 2003

(54) VARIABLE VALVE LIFT SYSTEM

(75) Inventor: Jin-Kook Kong, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/185,382

(22) Filed: Jun. 27, 2002

(65) Prior Publication Data

US 2003/0000491 A1 Jan. 2, 2003

(30) Foreign Application Priority Data

Jun. 29, 2001 (KR) ..... 2001-0038282

(51) Int. Cl.[7] ..... F01L 1/34

(52) U.S. Cl. ..... 123/90.16; 123/90.48; 123/90.55

(58) Field of Search ..... 123/90.16, 90.48, 123/90.55, 90.15–90.18, 90.56, 90.35, 90.43, 90.45, 90.46, 90.52

(56) References Cited

U.S. PATENT DOCUMENTS 5,431,133 A * 7/1995 Spath et al. ..... 123/90.16
5,709,180 A * 1/1998 Spath ..... 123/90.16
6,125,804 A * 10/2000 Kawai et al. ..... 123/90.16

* cited by examiner

*Primary Examiner*—Thomas Denion
*Assistant Examiner*—Kyle Riddle
(74) *Attorney, Agent, or Firm*—Pennie & Edmonds LLP

(57) ABSTRACT

The present invention relates to a variable valve lift system that varies a valve lift in two stages by selectively rigidly engaging a tappet shim. The system includes a tappet shim receiving an operational force of a cam; a body for transmitting an operational force of the tappet shim to a valve; first and second supports, the first supports being provided on a surface of the tappet shim opposing the body and the second supports being provided on a surface of the body opposing the tappet shim, the first and second supports being supported by elastic members; first and second stoppers mounted respectively in first and second hydraulic pressure chambers, elastic members being interposed between the first and second stoppers and the body, and the first and second stoppers undergoing operation to selectively rigidly support the tappet shim; and a third stopper mounted in a third hydraulic pressure chamber, which is formed opposing the tappet shim, an elastic member being interposed between the third stopper and the body.

4 Claims, 4 Drawing Sheets

VARIABLE VALVE LIFT SYSTEM

FIELD OF THE INVENTION

The present invention relates to a variable valve lift system. More particularly, the present invention relates to a variable valve lift system in which a valve lift is varied in two stages through changes in valve lift and cam duration by selectively rigidly engaging a tappet shim.

BACKGROUND OF THE INVENTION

An engine is typically structured such that cams mounted on a camshaft open and close intake and exhaust valves by rotation of the camshaft. In some modem engines, a variable valve control system is used in which valve timing and the amount of lift of the valves are controlled to improve performance and reduce fuel consumption.

With reference to FIGS. 1 and 2, a conventional variable valve lift system for controlling the degree of valve lift includes a tappet shim 3 that receives operational force from cam 1, and a body 7 for transmitting an operational force from the tappet shim 3 to a valve 5. Supports 11 are mounted to four points on the tappet shim 3 and supports 13 are mounted to four points on the body 7. The four points of the tappet shim 3 oppose the four points of the body 7. An elastic member 9 is interposed between each opposing pair of supports 11 and 13 to provide a biasing force to the supports 11 in the direction of the tappet shim 3 and a biasing force to the supports 13 in the direction of the body 7.

Further, stoppers 17 and 19 are mounted in hydraulic pressure chambers 21 and 23, respectively, of the body 7. An elastic member 15 is interposed between the stoppers 17 and 19. The stoppers 17 and 19 move by interaction with the elastic member 15 and with oil in the hydraulic pressure chambers 21 and 23. Oil holes 25 lead into the hydraulic pressure chambers 21 and 23 to enable the supply of oil thereto.

In the variable valve lift system structured as in the above, if oil is not supplied through the oil holes 25, the stoppers 17 and 19 are positioned within the hydraulic pressure chambers 21 and 23, respectively, as a result of receiving a biasing force of the elastic member 15. As a result, a state in which the tappet shim 3 is not upwardly supported is maintained. Hence, the operational force of the cam 1, transmitted to the tappet shim 3, is absorbed by the elastic members 9 positioned between the supports 11 and 13 such that the valve 5 is operated through the body 7. With such operation, the amount of lift of the valve 5 cannot be varied.

On the other hand, with reference to FIGS. 3 and 4, if oil (a) is supplied through the oil holes 25, the stoppers 17 and 19 overcome the biasing force of the elastic member 15 such that the stoppers 17 and 19 are forced in a direction toward each other to be positioned at the outside edge of the hydraulic pressure chambers 21 and 23, respectively. As a result, the tappet shim 3 is upwardly supported, that is, the tappet shim 3 cannot be downwardly displaced into the body 7 in this state. Hence, the operational force of the cam 1, transmitted through the tappet shim 3, operates the valve 5 through the body 7 after it is transmitted by the supports 11 and 13 and the stoppers 17 and 19. The amount of lift of the valve 5 is increased as a result.

However, in the above variable lift system, since the two stoppers 17 and 19 support the tappet shim 3 during application of a load by a cam lobe, the stoppers 17 and 19 experience wear. Further, the elastic member 15, interposed between the stoppers 17 and 19, does not precisely return the stoppers 17 and 19 when oil is exhausted from the hydraulic chambers 21 and 23.

SUMMARY OF THE INVENTION

The present invention provides a variable valve lift system in which valve lift is varied in two stages through changes in valve lift and cam duration by selectively rigidly engaging a tappet shim, and in which the durability of the support and the return of the stopper are improved. In a preferred embodiment, a tappet shim receives an operational force from the cam. A body transmits an operational force of the tappet shim to the valve. First and second supports, the first supports being provided on a surface of the tappet shim opposing the body and the second supports being provided on a surface of the body opposing the tappet shim, are supported by elastic members. First and second stoppers, mounted respectively in first and second hydraulic pressure chambers, formed on opposite sides of the body, are provided with an elastic member interposed between the first stopper and the body and an elastic member interposed between the second stopper and the body. The first and second stoppers selectively rigidly support the tappet shim in a second lift stage. A third stopper is mounted in a third hydraulic pressure chamber, which is formed in the body at a location opposing the tappet shim, and an elastic member is interposed between the third stopper and the body.

Preferably, the elastic members positioned in the first, second, and third hydraulic pressure chambers provide a biasing, pulling force to create resistance to hydraulic pressure acting on the first, second, and third stoppers. It is also preferable that the third stopper be mounted at substantially a center portion of the body to support the tappet shim in a state that is balanced during operation under the lobe load of the cam. It is further preferable that the third stopper is further configured to provide a higher position than the first and second stoppers during operation such that the third stopper supports the tappet shim at a high lift of the valve when oil is supplied to the third hydraulic pressure chamber.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
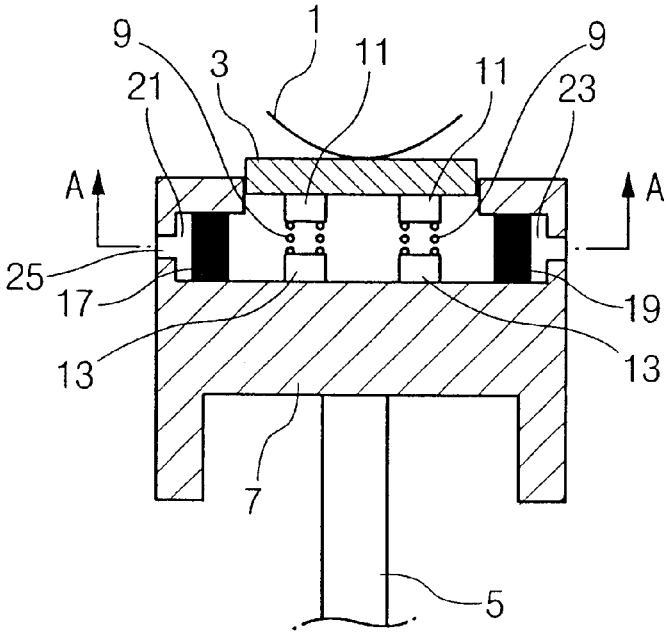
Fig. 1 (Prior Art)
FIG. 1 is a longitudinal sectional view of a conventional variable valve lift system.
Figure 2:
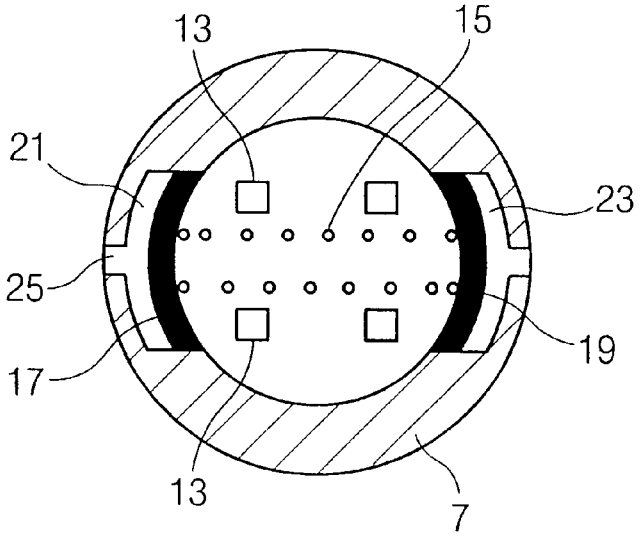
Fig. 2 (Prior Art)
FIG. 2 is a sectional view taken along line A—A of FIG. 1.
Figure 3:
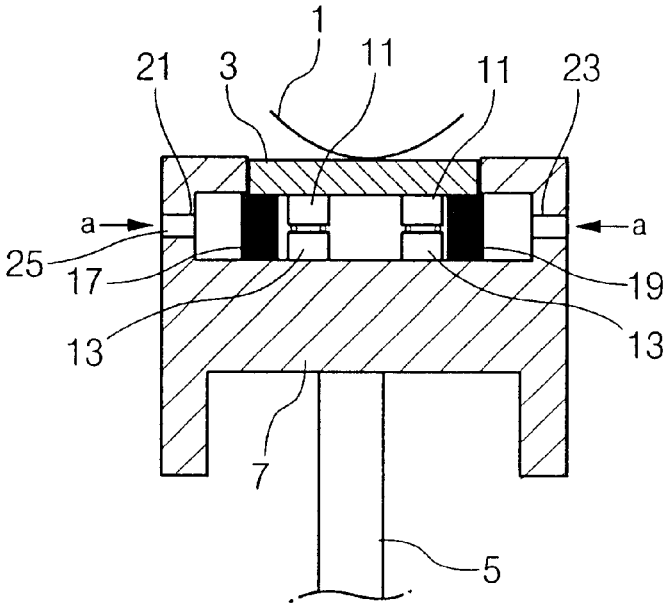
Fig. 3 (Prior Art)
FIG. 3 is a longitudinal sectional view of the conventional variable valve lift system of FIG. 1 shown in a state of operation.
Figure 4:
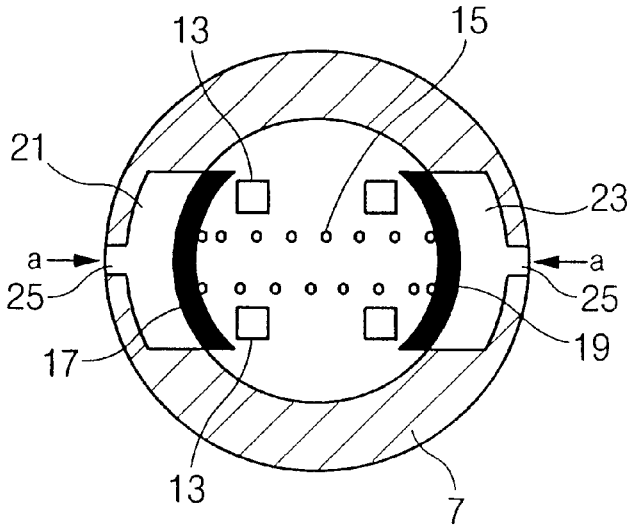
Fig. 4 (Prior Art)
FIG. 4 is a sectional view taken along line A—A of FIG. 1, in which the conventional variable valve lift system is in a state of operation.
Figure 5:
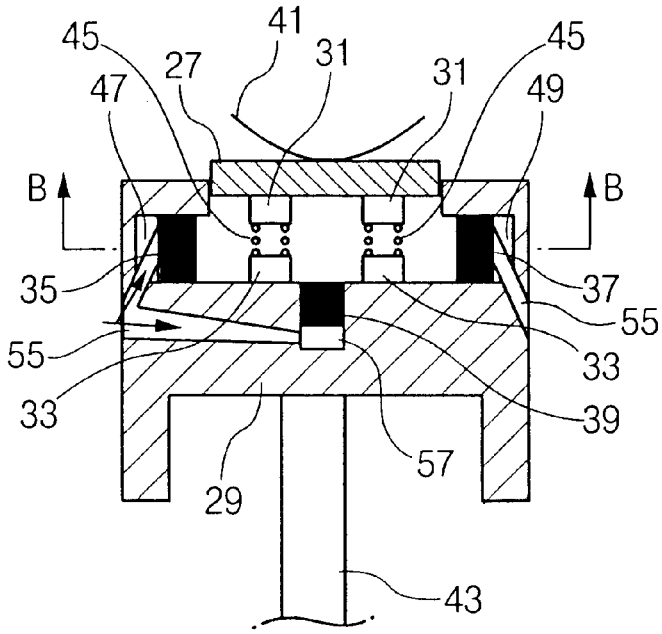
FIG. 5 is a longitudinal sectional view of a variable valve lift system according to a preferred embodiment of the present invention.

Preferred embodiments of the present invention will now be described in detail with reference to the accompanying drawings. Certain terminology is used in the following description for convenience and reference only, and will not be limiting. The words 'upper', 'lower', 'up', 'down', etc., designate directions in the drawings to which reference is made, without limiting the orientation of the invention in actual practice.

The variable valve lift system includes a tappet shim 27, a body 29, upper and lower supports 31 and 33, first and second stoppers 35 and 37, and a third stopper 39. The tappet shim 27 is provided in close contact with a rotating cam 41 such that the tappet shim 27 receives the lobe load of the cam 41. The tappet shim 27 is configured to undergo up and down motion in accordance with the rotation of the cam 41.

The body 29 cooperates with an upper portion of a valve 43 to transmit an operational force from the tappet shim 27 to the valve 43. The upper supports 31 are mounted to a surface of the tappet shim 27 opposing the body 29, and the lower supports 33 are mounted to a surface of the body 29 opposing the tappet shim 27. An elastic member 45 is interposed between each opposing pair of upper and lower supports 31 and 33 to provide a biasing force to the upper supports 31 in a direction of the tappet shim 27 and a biasing force to the lower supports 33 in a direction of the body 29.

Figure 6:
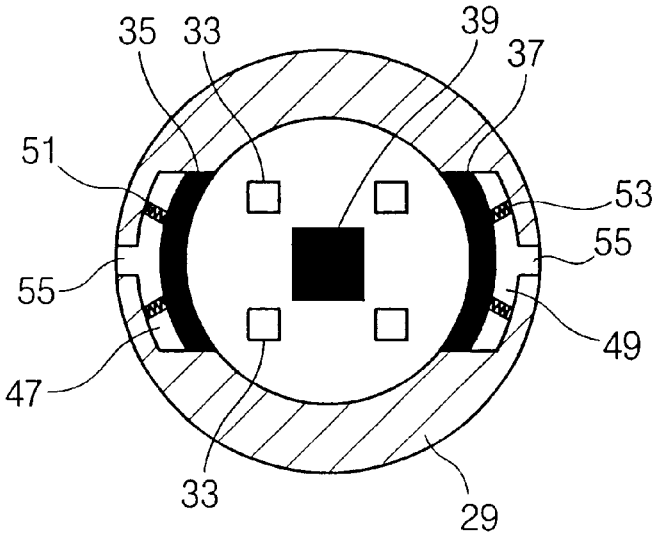
FIG. 6 is a sectional view taken along line B—B of FIG. 5.

The first and second stoppers 35 and 37, with particular reference to FIG. 6, are mounted in first and second hydraulic pressure chambers 47 and 49, respectively, which are formed on opposite sides of the body 29. Elastic members 51 and 53 are respectively interposed between the first and second stoppers 35 and 37 and an opposing wall of the body 29 within the respective first and second hydraulic pressure chambers 47 and 49. Oil holes 55 are formed in the body 29 leading into the first and second hydraulic pressure chambers 47 and 49. The first and second stoppers 35 and 37 are structured to selectively rigidly support the tappet shim 27, which is supported by the elastic members 45 and the upper and lower supports 31 and 33.

The elastic members 51 and 53 apply a biasing force (i.e., a pulling force) in a direction that resists pressure of oil supplied through the oil holes 55. When hydraulic pressure is not acting in the first and second hydraulic pressure chambers 47 and 49, the first and second stoppers 35 and 37 are positioned within the first and second hydraulic pressure chambers 47 and 49, respectively, by the biasing force of the elastic members 51 and 53, respectively, as shown in FIG. 6.

The third stopper 39 is mounted in a third hydraulic pressure chamber 57, which is formed in the body 29 at a location opposing the tappet shim 27. An elastic member 59 is interposed between the third stopper 39 and an opposing wall of the body 29 within the third hydraulic pressure chamber 57. An oil hole 55 is formed through the body 29, also leading into the third hydraulic pressure chamber 57. The elastic member 59 (FIG. 7) applies a biasing force in a direction that resists pressure of oil supplied through the oil hole 55 into the third hydraulic pressure chamber 57. That is, the biasing force of the elastic member 59 is in a direction to pull the third stopper 39 into the third hydraulic pressure chamber 57.

The third stopper 39 is mounted substantially in a center portion of the body 29 to support the tappet shim 27 in a balanced manner during operation of cam 41 and application of the lobe load. Further, the third stopper 39 is configured to provide a higher position than the first and second stoppers 35 and 37 during operation such that the tappet shim 27 is supported at high lift of the valve 43 when oil is supplied to the third hydraulic pressure chamber 57.

Operation of the variable valve lift system of the present invention structured as in the above will now be described.

If oil is not supplied through the oil holes 55, the first, second, and third stoppers 35, 37, and 39 are positioned within the first, second, and third hydraulic pressure chambers 47, 49, and 57, respectively, as a result of the biasing forces of the elastic members 51, 53, and 59, respectively. As a result, a state in which the tappet shim 27 is not upwardly supported is maintained.

In this state, the operational force of the cam 41 transmitted to the tappet shim 27 is absorbed by the elastic members 45 positioned between the supports 31 and 33 such that the valve 43 is operated through the body 29. With such operation, the amount of lift of the valve 43 is not varied.

Figure 7:
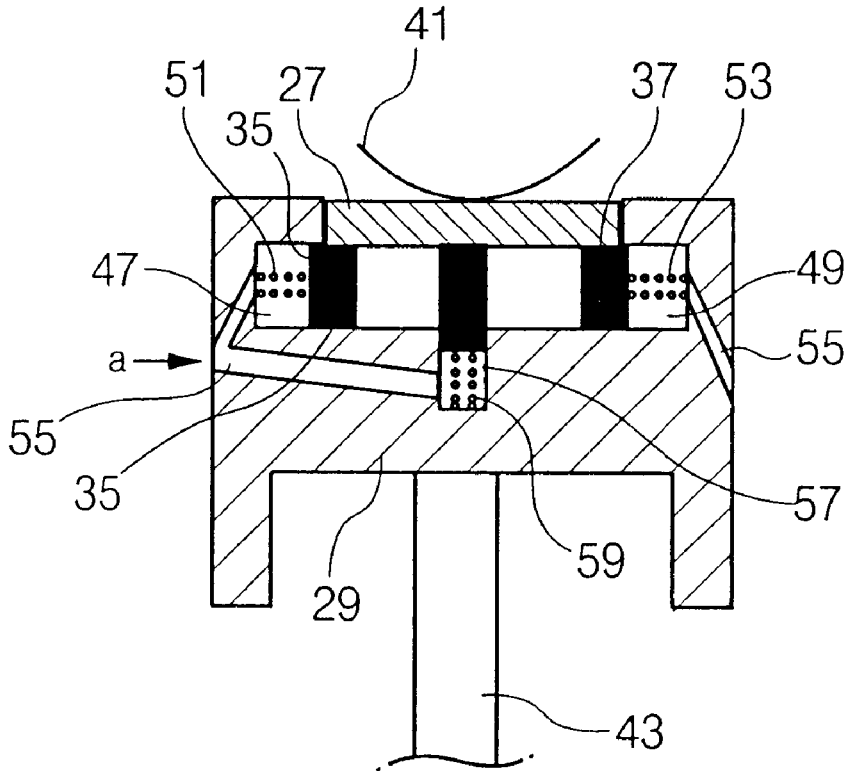
FIG. 7 is a longitudinal sectional view of the variable valve lift system of FIG. 5 shown in a state of operation.

On the other hand, with reference to FIG. 7, if oil (a) is supplied through the holes 55, the first, second, and third stoppers 35, 37, and 39 overcome the biasing forces of the elastic members 51, 53, and 59, respectively, such that the first, second, and third stoppers 35, 37, and 39 are forced out of the first, second, and third hydraulic pressure chambers 47, 49, and 57, respectively. As a result, the tappet shim 27 is upwardly supported, that is, the tappet shim 27 cannot be downwardly displaced into the body 29.

It is preferable that the third stopper 39 is configured to provide a higher position than the first and second stoppers 35 and 37 during operation. The third stopper 39 then supports the tappet shim 27 before the first and second stoppers 35 and 37 such that a higher lift amount for valve 43 may be provided.

Therefore, the operational force of the cam 41, transmitted to the tappet shim 27, operates the valve 43 through the body 29 after it is transmitted by the first and second supports 31 and 33 and the first, second, and third stoppers 35, 37, and 39. The amount of lift of the valve 43 is varied as a result.

In the variable valve lift system of the present invention structured and operating as in the above, with the provision of the first, second, and third stoppers, and the elastic members supporting the first, second, and third stoppers mounted in the first, second, and third hydraulic pressure chambers, the valve lift is varied in two steps, and the resistance of the supports and return of the stoppers are improved.

Further, when oil is not supplied to the hydraulic pressure chambers, the valve lift and cam duration (time of force applied to tappet) decrease to a level ideal for low and medium speeds and when idling. Also, this enables lean combustion to minimize emissions before the catalytic converted is warmed up. When oil is supplied to the hydraulic pressure chambers, a high valve lift is realized to improve engine output.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A variable valve lift system, comprising:

a tappet shim configured to receive operational force from a cam;

a body cooperating with the tappet shim to transmit operational force from the tappet shim to a valve;

first and second supports, the first supports being provided on a surface of the tappet shim opposing the body and the second supports being provided on a surface of the body opposing the tappet shim, said first and second supports being separated by elastic members;

first and second stoppers mounted respectively in first and second hydraulic pressure chambers formed on opposite sides of the body with an elastic member interposed between the first stopper and the body and an elastic member being interposed between the second stopper and the body, said first and second stoppers operable to selectively rigidly support the tappet shim; and a third stopper mounted in a third hydraulic pressure chamber formed in the body at a location opposing the tappet shim, with an elastic member being interposed between the third stopper and the body.

2. The variable valve system of claim 1, wherein the elastic members positioned in the first, second, and third hydraulic pressure chambers provide a pulling force to provide resistance to hydraulic pressure acting on the first, second, and third stoppers.

3. The variable valve system of claim 1, wherein the third stopper is mounted substantially in a center portion of the body to support the tappet shim in a balanced state.

4. The variable valve system of claim 1, wherein the third stopper is configured to contact the tappet shim at a higher position than the first and second stoppers during operation such that the third stopper supports the tappet shim to provide high lift of the valve when oil is supplied to the third hydraulic pressure chamber.

* * * * *